US008083965B2

(12) United States Patent
Tagawa et al.

(10) Patent No.: US 8,083,965 B2
(45) Date of Patent: Dec. 27, 2011

(54) REFRIGERATING MACHINE OIL

(75) Inventors: Kazuo Tagawa, Yokohama (JP); Katsuya Takigawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 216 days.

(21) Appl. No.: 10/591,500

(22) PCT Filed: Mar. 2, 2005

(86) PCT No.: PCT/JP2005/003513

§ 371 (c)(1), (2), (4) Date: May 25, 2007

(87) PCT Pub. No.: WO2005/085399

PCT Pub. Date: Sep. 15, 2005

(65) Prior Publication Data

US 2007/0275865 A1 Nov. 29, 2007

(30) Foreign Application Priority Data

Mar. 4, 2004 (JP) ..... P2004-061252
Mar. 4, 2004 (JP) ..... P2004-061253

(51) Int. Cl.

| | |
|---|---|
| ***C09K 5/00*** | (2006.01) |
| ***C07D 403/00*** | (2006.01) |
| ***C10G 53/16*** | (2006.01) |
| ***C10M 141/10*** | (2006.01) |

(52) U.S. Cl. ..... 252/68; 252/67; 548/255; 208/78; 508/438

(58) Field of Classification Search ..... 508/438; 548/255; 252/67, 68; 208/78
See application file for complete search history.

(56) References Cited

U.S. PATENT DOCUMENTS

| | | | | |
|---|---|---|---|---|
| 4,521,296 | A * | 6/1985 | Kunihiro et al. | 208/87 |
| 6,231,782 | B1 * | 5/2001 | Shimomura et al. | 252/68 |
| 6,736,991 | B1 * | 5/2004 | Cohen et al. | 252/68 |

FOREIGN PATENT DOCUMENTS

| | | |
|---|---|---|
| CN | 1297472 | 5/2001 |
| CN | 1319126 | 10/2001 |
| CN | 1470626 | 1/2004 |
| JP | 55-84879 | 6/1980 |
| JP | 56-157487 | 12/1981 |
| JP | 62-295995 | 12/1987 |
| JP | 01-161089 | 6/1989 |
| JP | 08-209182 | 8/1996 |
| JP | 09-302373 | 11/1997 |
| JP | 2000-63866 | 2/2000 |
| JP | 2000-129281 | 5/2000 |
| JP | 2004-18631 | 1/2004 |
| JP | 2005-162883 | 6/2005 |
| KR | 10-2001-0099626 | 11/2001 |
| KR | 10-2003-0095987 | 12/2003 |
| WO | WO 00/60031 | 10/2000 |
| WO | WO 2005/012469 | 2/2005 |

OTHER PUBLICATIONS

International Search Report.
Japanese Office Action dated Nov. 17, 2009.
Japanese Office Action dated Jan. 5, 2010.
Korean Office Action dated May 20, 2011.

* cited by examiner

*Primary Examiner* — Glenn Caldarola
*Assistant Examiner* — Vishal Vasisth
(74) *Attorney, Agent, or Firm* — Finnegan, Henderson, Farabow, Garrett & Dunner, LLP

(57) ABSTRACT

The refrigerating machine oil of the present invention contains a mineral oil whose nitrogen content is not more than 50 ppm by mass and whose percent in aromatic ring structures (% $C_A$) is from 5 to 25. With the refrigerating machine oil of the present invention, high levels of lubricity, stability, and miscibility with refrigerants are attained, with a good balance between these, so refrigerating and air conditioning machines can be operated stably over a longer period.

1 Claim, No Drawings

REFRIGERATING MACHINE OIL

This application is a 371 of PCT/JP05/03513, filed Mar. 2, 2005.

TECHNICAL FIELD

This invention relates to a refrigerating machine oil used in a refrigerating or air conditioning machine.

BACKGROUND ART

Refrigerating machine oils in which a mineral oil is used as the base oil are widely used in refrigerating and air conditioning machines that make use of R22 and other such HCFC (hydrochlorofluorocarbon) refrigerants (see the patent documents 1 and 2)

[Patent document 1] Japanese Patent Application Laid-Open No. S55-84879

[Patent document 2] Japanese Patent Application Laid-Open No. S56-157487

DISCLOSURE OF THE INVENTION

One performance aspect that is required of a refrigerating machine oil is that it have excellent miscibility with refrigerants at low temperature and have a low pour point. Accordingly, what is known as a naphthene-based mineral oil, which has a high naphthene content as determined by n-d-M ring analysis, can be used to advantage because of its low pour point and good miscibility with fluorocarbon refrigerants.

From the standpoint of long-term use, a refrigerating machine oil needs to have excellent lubricity and stability such as anti-sludge performance. For instance, one possible way to improve stability is to raise the degree of refining of the base oil and reduce the content of polar substances such as sulfur.

However, the inventors have learned that when a base oil is refined to a higher degree, there is also a reduction in the aromatic content of the base oil, so miscibility decreases and performance as a refrigerating machine oil is lost. Another problem that is encountered is that lubricity decreases when there is a reduction in the content of aromatics or polar substances such as sulfur. One possible way to increase lubricity is to add a sulfur- or phosphorus-based additive, for example, but these additives are highly active, and stability tends to decrease when these are added to a conventional refrigerating machine oil.

It was thus difficult to achieve both good stability and good lubricity with a conventional refrigerating machine oil. In particular, as modern systems have become more efficient, compressor output has risen, and the discharge temperature has also tended to be higher. Consequently, there is a need for a refrigerating machine oil that is chemically stable with respect to heat, oxidation, and so forth. Therefore, the development of a novel refrigerating machine oil that has excellent stability and lubricity, and also has excellent miscibility with refrigerants, would be very welcome.

The present invention was conceived in light of this situation, and it is an object thereof to provide a refrigerating machine oil that strikes a good balance between stability, lubricity, and miscibility with refrigerants, and that allows refrigerating and air conditioning machines to be operated stably for extended periods.

To solve the above problems, the refrigerating machine oil of the present invention is characterized by containing a mineral oil whose nitrogen content is not more than 50 ppm by mass and whose percent in aromatic ring structures (% $C_A$) is from 5 to 25.

With the refrigerating machine oil of the present invention, when the nitrogen content and percent in aromatic ring structures % $C_A$ in the mineral oil satisfy the above conditions, the stability, lubricity, and refrigerant miscibility of the refrigerating machine oil are all sufficiently enhanced, with a good balance struck between them, so refrigerating and air conditioning machines that make use of HCFC refrigerants and so forth can be operated stably for extended periods.

Because the lubricity-increasing effect of the refrigerating machine oil of the present invention also contributes to increasing the energy efficiency of refrigerating and air conditioning machines, this oil is also extremely useful in terms of energy conservation and reducing the cost of manufacturing refrigerating and air conditioning machines. Specifically, increasing the lubricity of a refrigerating machine oil in conventional refrigerating and air conditioning machines has not been studied adequately, and there is also concern that the use of anti-wear property improvers and oiliness agents could have an adverse effect, so improvements to anti-wear property have generally been accomplished through modifications on the hardware side, such as the compressor. In contrast, with the refrigerating machine oil of the present invention, since its excellent lubricity adequately lowers the sliding load inside the compressor, the energy efficiency of refrigerating and air conditioning machines fan be increased even without any modification to hardware such as compressors or heat exchangers. Also, the increase in lubricity afforded by the present invention allows sliding members made of lower-grade materials, that is, less expensive sliding members, to be used as the sliding members of compressors, and this translates into lower cost of refrigerating and air conditioning machines. On the other hand, energy efficiency can be markedly increased by combining the refrigerating machine oil of the present invention with a compressor or the like with improved anti-wear property.

The sulfur content of the mineral oil in the refrigerating machine oil of the present invention is preferably not more than 150 ppm by mass. If the sulfur content and nitrogen content of the mineral oil satisfy the conditions set forth above, and if the sulfur content is not more than 150 ppm by mass, stability will be further enhanced in addition to the refrigerating machine oil having good lubricity and miscibility with refrigerants.

Also, the refrigerating machine oil of the present invention preferably further contains a phosphorothionate and a phosphorus-based additive other than said phosphorothionate (hereinafter sometimes called simply a "phosphorus-based additive").

Because the refrigerating machine oil of the present invention contains both a phosphorothionate and a phosphorus-based additive, the lubricity and stability of the refrigerating machine oil of the present invention can both be increased even more, allowing refrigerating and air conditioning machines in which HCFC refrigerants and the like are used to be stably operated for extended periods. Using a phosphorothionate and a phosphorus-based additive together also contributes to increasing the energy efficiency of refrigerating and air conditioning machines, and is therefore extremely useful in terms of energy conservation and reducing the cost of manufacturing refrigerating and air conditioning machines. This effect of increasing lubricity and stability is only obtained by using a phosphorothionate and a phosphorus-based additive together, and is much more pronounced than when either a phosphorothionate or a phosphorus-based additive is used alone.

With the refrigerating machine oil of the present invention, high levels of lubricity, stability, and miscibility with refrigerants are attained, with a good balance between these, and good electrical insulation and long-term reliability can also be obtained. Therefore, refrigerating and air conditioning machines can be operated stably over a longer period.

BEST MODE FOR CARRYING OUT THE INVENTION

Preferred embodiments of the present invention will now be described in detail.

Base Oil

The refrigerating machine oil of the present invention contains a mineral oil whose nitrogen content is not more than 50 ppm by mass and whose percent in aromatic ring structures (% $C_A$) is from 5 to 25. Such a mineral oil can be used favorably as the base oil in the refrigerating machine oil of the present invention.

The term "nitrogen content" as used in the present invention means the value measured according to JIS K 2609 (Micro Electricity Titration). Examples of the nitrogen component contained in the crude oil include ammonia, ammonium, ammonium carbonate, ammonium chloride, and other such inorganic ammonia compounds, and pyridine, quinoline, naphthene base, and other such heterocyclic compounds. From the standpoint of its effect on stability, the amount in which the nitrogen compound is contained is not more than 50 ppm by mass, and preferably not more than 30 ppm by mass, and more preferably not more than 20 ppm by mass, with not more than 15 ppm by mass being best of all.

The "percent in aromatic ring structures (% $C_A$)" referred to in the present invention means the value calculated by the n-d-M method set forth in ASTM D3238. This percent in aromatic ring structures (% $C_A$) greatly affects miscibility with refrigerants, which is a basic performance aspect of a base oil used for a refrigerating machine oil, and also affects lubricity and stability. Accordingly, the percent in aromatic ring structures (% $C_A$) is not less than 5, and from the standpoint of the effect on lubricity, it is preferably not less than 8. On the other hand, the percent in aromatic ring structures (% $C_A$) is not more than 25, and from the standpoint of the effect on stability and the hue stability of the oil, it is preferably not more than 20, and more preferably not more than 15.

As long as its nitrogen component and aromatic component satisfy the above conditions, the mineral oil pertaining to the present invention may further contain a naphthene component (% $C_N$) and a paraffin component (% $C_P$). In terms of miscibility with refrigerants, the percent in naphthene ring structures (% $C_N$) calculated by the n-d-M method set forth in ASTM D3238 is preferably not less than 30, and more preferably not less than 35, with not less than 40 being best of all. In terms of viscosity temperature characteristics, the percent in naphthene ring structures (% $C_N$) is preferably not more than 60. Meanwhile, in terms of miscibility, the percent in paraffin chains (% $C_P$) calculated by the above-mentioned n-d-M method is preferably not more than 60, and more preferably not more than 55. In terms of lubricity, the percent in paraffin chains (% $C_P$) is not less than 35, and more preferably not less than 40.

Also, in terms of its effect on stability, the sulfur content of the mineral oil pertaining to the present invention is preferably not more than 150 ppm by mass, and more preferably not more than 100 ppm by mass, and even more preferably not more than 75 ppm by mass, with not more than 50 ppm by mass being best of all. The term "sulfur content" as used in the present invention means the value measured according to JIS K 2541. Examples of sulfur components include carbon disulfide, mercaptan, alkyl sulfide, alkyl disulfide, thiophane, thiophene, and sulfonic acid.

Examples of mineral oils include paraffin-based mineral oils and naphthene-based mineral oils obtained when a lubricant fraction yielded by distilling a paraffin-based crude oil, a intermediate-based crude oil or a naphthene-based crude oil under normal pressure and under reduced pressure is refined by carrying out at least one of processes of solvent deasphalting, solvent extraction, hydrocracking, solvent dewaxing, catalytic dewaxing, hydrorefining, sulfuric acid washing, or clay treatment.

Of these mineral oils, the use of one that has been highly refined (hereinafter referred to as "highly refined mineral oil") is preferable because the thermal and oxidation stability will be superior. Specific examples of highly refined mineral oils include refined oils obtained by subjecting a paraffin base crude oil, intermediate base crude oil, or naphthene base crude oil to normal pressure distillation, or subjecting the residue oil of normal pressure distillation to reduced pressure distillation, and then refining the resulting distillate by a standard method; deeply dewaxed oils obtained by further performing a deep dewaxing treatment after refining; and hydrotreated oils obtained by hydrotreatment.

There is no particular restriction on the refining method in the above-mentioned refining step, and any conventional method can be used, but examples include (a) hydrotreatment, (b) dewaxing (solvent dewaxing or hydrodewaxing), (c) solvent extraction, (d) alkali washing or sulfuric acid washing, and (e) clay treatment, each of which can be performed alone, or two or more may be combined in a suitable order. It is also effective to divide up any of the above treatments (a) to (e) into a plurality of stages and perform these over and over. More specifically, examples include (i) a method in which a distillate is hydrotreated, or a method in which it is first hydrotreated and then subjected to alkali washing or sulfuric acid washing; (ii) a method in which a distillate is hydrotreated and then dewaxed; (iii) a method in which a distillate is subjected to solvent extraction and then hydrotreated; (iv) a method in which a distillate is subjected to a two- or three-stage hydrotreatment, or then subjected to alkali washing or sulfuric acid washing; and (v) a method in which the above-mentioned treatments (i) to (iv) are performed, after which dewaxing is performed again, and this is followed by deep dewaxing.

The mineral oil used in the present invention can be obtained, for example, by using a crude oil with a nitrogen content of not more than 0.3% and a percent in aromatic ring structures (% $C_A$) of not more than 30%, and preferably with a sulfur content of not more than 0.5% by mass, subjecting this raw material to distillation under normal or reduced pressure, subjecting the lubricating oil fraction thus obtained to hydrotreatment at a pressure of 100 to 200 kg/cm$^2$ and a temperature of 300 to 400° C. and in the presence of a Co—Mo or Ni—W-based catalyst, and then performing solvent refining using furfural, and then performing hydrotreatment again at a pressure of 100 to 200 kg/cm$^2$ and a temperature of 300 to 400° C., and finally refining this product by clay treatment.

The pour point of the mineral oil pertaining to the present invention is preferably not higher than 0° C., and more preferably not higher than −10° C., and even more preferably not higher than −20° C., with −30° C. or lower being best of all. If the pour point of the mineral oil is over 0° C., the oil may become a solid at normal temperature and will tend to be more difficult to handle. The term "pour point" as used in the present invention means the value measured according to JIS K 2269.

The acid value of the mineral oil pertaining to the present invention is preferably not more than 0.05 mgKOH/g, and more preferably not more than 0.03 mgKOH/g. Stability tends to decrease if the acid value of the mineral oil is over 0.05 mgKOH/g. The term "acid value" as used in the present invention means the value measured according to JIS K 2501.

Further, the upper limit to the kinematic viscosity at 40° C. of the mineral oil pertaining to the present invention is preferably 200 $mm^2/s$, and more preferably 100 $mm^2/s$. The lower limit to this kinematic viscosity, meanwhile, is preferably 3 $mm^2/s$, and more preferably 5 $mm^2/s$. If the kinematic viscosity exceeds this upper limit, efficiency will tend to be poor in actual performance, but if the kinematic viscosity is under the lower limit, anti-wear property will tend to be poor. The term "kinematic viscosity" as used in the present invention means the value measured according to JIS K 2283.

Also, the viscosity coefficient of the mineral oil pertaining to the present invention is preferably not less than −10, and more preferably not less than 0. Fluidity at low temperature will tend to be poor if the viscosity coefficient of the mineral oil is less than −10. The term "viscosity coefficient" as used in the present invention means the value measured according to JIS K 2283.

The amount in which mineral oil whose nitrogen content is not more than 50 ppm by mass and whose percent in aromatic ring structures (% $C_A$) is 5 to 25 is contained in the refrigerating machine oil of the present invention is preferably not less than 70% by mass, and more preferably not less than 80% by mass, and even more preferably not less than 90% by mass, with not less than 95% by mass being best of all, with respect to the total weight of the refrigerating machine oil. Miscibility, stability, and other such characteristics of the base oil will tend to be poor if the mineral oil content is less than 70% by mass.

The refrigerating machine oil of the present invention contains the mineral oil specified above as its base oil, but may additionally contain a mineral oil other than the mineral oil specified above, a hydrocarbon-based synthetic oil, an oxygen-containing synthetic oil, or the like (hereinafter referred to as "other base oil").

Examples of mineral oils include paraffin-based mineral oils and naphthene-based mineral oils obtained when a lubricant fraction yielded by distilling a paraffin-based crude oil, a intermediate-based crude oil or a naphthene-based crude oil under normal pressure and under reduced pressure is refined by carrying out at least one of processes of solvent deasphalting, solvent extraction, hydrocracking, solvent dewaxing, catalytic dewaxing, hydrorefining, sulfuric acid washing, or clay treatment.

When the refrigerating machine oil of the present invention comprises a mineral oil which does not satisfy the requirement of which the nitrogen content is not greater than 50 ppm by mass and/or the requirement of which the percent in aromatic ring structures (% $C_A$) is from 5 to 25, highly refined mineral oil is preferable as the mineral oil because the thermal and oxidation stability will be superior. Specific examples of highly refined mineral oils include refined oils obtained by subjecting a paraffin base crude oil, intermediate base crude oil, or naphthene base crude oil to normal pressure distillation, or subjecting the residue oil of normal pressure distillation to reduced pressure distillation, and then refining the resulting distillate by a standard method; deeply dewaxed oils obtained by further performing a deep dewaxing treatment after refining; and hydrotreated oils obtained by hydrotreatment.

Of the highly refined mineral oils, naphthene-based mineral oils, and mineral oils obtained by deep dewaxing are favorable in terms of their low temperature fluidity, because there is no wax precipitation at low temperature, and so forth. This deep dewaxing is usually accomplished by a solvent dewaxing method performed under stringent conditions, a catalytic dewaxing method involving the use of a zeolite catalyst, or the like.

The nonaromatic unsaturated component (the degree of unsaturation) of this highly refined mineral oil is preferably 10% by mass or less, and more preferably 5% by mass or less, and even more preferably 1% by mass or less, with 0.1% by mass or less being particularly favorable. Sludge will tend to be produced if the nonaromatic unsaturated component accounts for more than 10% by mass, and as a result, there will be a tendency for blockage to occur in the expansion mechanism, such as the capillaries that make up the refrigerant circulation system.

Examples of synthetic oils that can be used in the present invention include olefin polymers, naphthalene compounds, alkylbenzenes, and other such hydrocarbon-based oils; and esters, polyoxyalkylene glycols, polyvinyl ethers, ketones, polyphenyl ethers, silicones, polysiloxanes, perfluoroethers, and other such oxygen-containing synthetic oils.

From the standpoint of achieving high levels of stability and lubricity and striking a good balance between them, the amount in which the other base oil is contained in the refrigerating machine oil of the present invention is preferably not more than 30% by mass, and more preferably not more than 20% by mass, and even more preferably not more than 10% by mass, with not more than 5% by mass being particularly favorable, and it is best of all for no other base oil to be contained.

The refrigerating machine oil of the present invention preferably contains a phosphorus-based additive in order to further enhance anti-wear property. The use of a phosphorus-based additive is extremely effective in terms of further increasing the effect of enhancing anti-wear property and friction characteristics accomplished by the use of an oiliness agent (discussed below). Also, with the present invention, just one type of phosphorus-based additive may be used alone, or a combination of two or more types may be used, but it is preferable to use a phosphorothionate along with a phosphorus-based additive other than said phosphorothionate.

Phosphorothionate

The compounds expressed by the following General Formula (1) can be used favorably as the phosphorothionate.

[Chemical Formula 1]

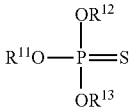

(1)

(In the formula, $R^{11}$ to $R^{13}$ may be the same or different and are each a $C_1$ to $C_{24}$ hydrocarbon group.)

Specific examples of the $C_1$ to $C_{24}$ hydrocarbon group expressed by $R^{11}$ to $R^{13}$ include an alkyl group, cycloalkyl group, alkenyl group, alkylcycloalkyl group, aryl group, alkylaryl group, and arylalkyl group.

Examples of alkyl groups include a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, octadecyl group, and other such alkyl groups (these alkyl groups may be linear or branched).

Examples of cycloalkyl groups include a cyclopentyl group, cyclohexyl group, cycloheptyl group, and other such $C_5$ to $C_7$ cycloalkyl groups. Examples of the above-mentioned alkylcycloalkyl groups include a methylcyclopentyl group, dimethylcyclopentyl group, methylethylcyclopentyl group, diethylcyclopentyl group, methylcyclohexyl group, dimethylcyclohexyl group, methylethylcyclohexyl group, diethylcyclohexyl group, methylcycloheptyl group, dimethylcycloheptyl group, methylethylcycloheptyl group, diethylcycloheptyl group, and other such $C_6$ to $C_{11}$ alkylcycloalkyl groups (the alkyl group may be substituted at any position on the cycloalkyl group).

Examples of alkenyl groups include a butenyl group, pentenyl group, hexenyl group, hepentyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, and other such alkenyl groups (these alkenyl groups may be linear or branched, and the double bonds may be at any position).

Examples of aryl groups include a phenyl group, naphthyl group, and other such aryl groups. Examples of the above-mentioned alkylaryl groups include a tolyl group, xylyl group, ethylphenyl group, propylphenyl group, butylphenyl group, pentylphenyl group, hexylphenyl group, heptylphenyl group, octylphenyl group, nonylphenyl group, decylphenyl group, undecylphenyl group, dodecylphenyl group, and other such $C_7$ to $C_{18}$ alkylaryl groups (the alkyl groups may be either linear or branched, and may be substituted at any position on the aryl group).

Examples of arylalkyl groups include a benzyl group, phenylethyl group, phenylpropyl group, phenylbutyl group, phenylpentyl group, phenylhexyl group, and other such $C_7$ to $C_{12}$ arylalkyl groups the alkyl groups may be either linear or branched).

The $C_1$ to $C_{24}$ hydrocarbon groups expressed by $R^{11}$ to $R^{13}$ above are preferably an alkyl group, aryl group, or alkylaryl group, and more preferably a $C_4$ to $C_{18}$ alkyl group, $C_7$ to $C_{24}$ alkylaryl group, or phenyl group.

Specific examples of the phosphorothionate expressed by General Formula (1) include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyl diphenyl phosphorothionate, xylenyl diphenyl phosphorothionate, tris(n-propyl phenyl) phosphorothionate, tris(isopropyl phenyl) phosphorothionate, tris(n-butyl phenyl) phosphorothionate, tris(isobutyl phenyl) phosphorothionate, tris(s-butyl phenyl) phosphorothionate, and tris(t-butyl phenyl) phosphorothionate. Mixtures of these can also be used.

There are no restrictions on the amount of the phosphorothionate, but the amount of the phosphorothionate is preferably 0.01 to 5% by mass, more preferably 0.02 to 3.0% by mass, and further more preferably 0.02 to 2.0% by mass with respect to the total amount of the composition (the sum of the base oils and the additives).

Phosphorus-Based Additive Other than Phosphorothionate

The phosphorus-based additive other than the phosphorothionate is preferably at least one type of phosphorus compound selected from the group consisting of phosphoric acid esters, acidic phosphoric acid esters, amine salts of acidic phosphoric acid esters, chlorinated phosphoric acid esters, and phosphorous acid esters. These phosphorus compounds are esters of phosphoric acid or phosphorous acid and an alkanol, or polyether type of alcohol, or derivatives of these esters.

Of the phosphorus-based additives, examples of phosphoric acid esters include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylyl phosphate, cresyl diphenyl phosphate, and xylenyl diphenyl phosphate.

Examples of acidic phosphoric esters include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, and dioleyl acid phosphate.

Examples of amine salts of acidic phosphoric esters include salts of the above-mentioned acidic phosphoric esters and amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine.

Examples of chlorinated phosphoric esters include tris-dichloropropyl phosphate, tris-chloroethyl phosphate, tris-chlorophenyl phosphate, and polyoxyalkylene bis[di(chloroalkyl)]phosphate.

Examples of phosphorous esters include dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite, and tricresyl phosphite. The mixtures of these can also be used.

When one of these phosphorus-based additives other than phosphorothionate is added to the refrigerating machine oil of the present invention, there are no particular restrictions on the amount added, but usually it is preferably 0.01 to 5.0% by mass, and more preferably 0.02 to 3.0% by mass, and even more preferably 0.02 to 2.0% by mass, with respect to the total amount of the refrigerating machine oil (the sum of the base oil and all of the added additives). If the phosphorus-based additive other than phosphorothionate is contained in an amount of 5.0% by mass or more, not only will there not be any increase in the effect corresponding to the higher content, but stability will also decrease.

Benzotriazole and/or Derivative Thereof

The refrigerating machine oil of the present invention preferably further contains benzotriazole and/or a derivative thereof. The effect of enhancing anti-wear property and friction property can be further enhanced by having benzotriazole and/or a derivative thereof contained.

Benzotriazole is a compound expressed by the following Formula (2).

[Chemical Formula 2]

(2)

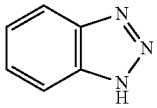

Examples of benzotriazole derivatives include the alkylbenzotriazoles expressed by the following General Formula (3), and the (alkyl)aminoalkylbenzotriazoles expressed by the following General Formula (4).

[Chemical Formula 3]

(3)

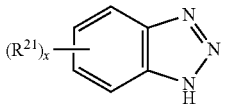

[Chemical Formula 4]

(4)

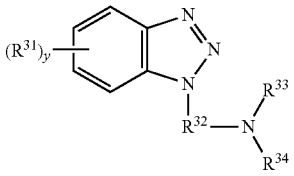

In Formula (3) above, $R^{21}$ is a $C_1$ to $C_4$ linear or branched alkyl group, and preferably a methyl group or ethyl group, and x is a number from 1 to 3, and preferably 1 or 2. Examples of $R^{21}$ include a methyl group, ethyl group, n-propyl group, isopropyl group, n-butyl group, isobutyl group, sec-butyl group, and tert-butyl group. In terms of especially good prevention of oxidation, it is preferable that $R^{21}$ is a methyl group or ethyl group and x is a number from 1 or 2. Examples of the alkylbenzotriazoles expressed by General Formula (3) include methylbenzotriazole (tolyltriazole), dimethylbenzotriazole, ethylbenzotriazole, ethylmethylbenzotriazole, diethylbenzotriazole, and mixtures of these.

In Formula (4) above, $R^{31}$ is a $C_1$ to $C_4$ linear or branched alkyl group, and preferably a methyl group or ethyl group, $R^{32}$ is a methyl group or ethyl group, $R^{33}$ and $R^{34}$ may be the same or different and are each a hydrogen atom or a $C_1$ to $C_{18}$ linear or branched alkyl group, and preferably a $C_1$ to $C_{12}$ linear or branched alkyl group, and y is a number from 0 to 3, and preferably 0 or 1. Examples of $R^{31}$ include a methyl group, ethyl group, n-propyl group, isopropyl group, n-butyl group, isobutyl group, sec-butyl group, tert-butyl group. Examples of $R^{33}$ and $R^{34}$ include independently a hydrogen atom, methyl group, ethyl group, propyl group, isopropyl group, n-butyl group, isobutyl group, sec-butyl group, tert-butyl group, linear or branched pentyl group, linear or branched hexyl group, linear or branched heptyl group, linear or branched octyl group, linear or branched nonyl group, linear or branched decyl group, linear or branched undecyl group, linear or branched dodecyl group, linear or branched tridecyl group, linear or branched tetradecyl group, linear or branched pentadecyl group, linear or branched hexadecyl group, linear or branched heptadecyl group, linear or branched octadecyl group, or other such alkyl group.

In terms of especially good prevention of oxidation, the (alkyl)aminobenzotriazole expressed by Formula (4) above is preferably a dialkylaminoalkylbenzotriazole or dialkylaminoalkyltolyltriazole in which $R^{31}$ is a methyl group, y is 0 or 1, $R^{32}$ is a methylene group or ethylene group, and $R^{33}$ and $R^{34}$ are each a $C_1$ to $C_{12}$ linear or branched alkyl group, or a mixture of these compounds. Examples of these dialkylaminoalkylbenzotriazoles include dimethylaminomethylbenzotriazole, diethylaminomethylbenzotriazole, di-(linear or branched) propylaminomethylbenzotriazole, di-(linear or branched) butylaminomethylbenzotriazole, di-(linear or branched) pentylaminomethylbenzotriazole, di-(linear or branched) hexylaminomethylbenzotriazole, di-(linear or branched) heptylaminomethylbenzotriazole, di-(linear or branched) octylaminomethylbenzotriazole, di-(linear or branched) nonylaminomethylbenzotriazole, di-(linear or branched) decylaminomethylbenzotriazole, di-(linear or branched) undecylaminomethylbenzotriazole, di-(linear or branched) dodecylaminomethylbenzotriazole; dimethylaminoethylbenzotriazole, diethylaminoethylbenzotriazole, di-(linear or branched) propylaminoethylbenzotriazole, di-(linear or branched) butylaminoethylbenzotriazole, di-(linear or branched) pentylaminoethylbenzotriazole, di-(linear or branched) hexylaminoethylbenzotriazole, di-(linear or branched) heptylaminoethylbenzotriazole, di-(linear or branched) octylaminoethylbenzotriazole, di-(linear or branched) nonylaminoethylbenzotriazole, di-(linear or branched) decylaminoethylbenzotriazole, di-(linear or branched) undecylaminoethylbenzotriazole, di-(linear or branched) dodecylaminoethylbenzotriazole; dimethylaminomethyltolyltriazole, diethylaminomethyltolyltriazole, di-(linear or branched) propylaminomethyltolyltriazole, di-(linear or branched) butylaminomethyltolyltriazole, di-(linear or branched) pentylaminomethyltolyltriazole, di-(linear or branched) hexylaminomethyltolyltriazole, di-(linear or branched) heptylaminomethyltolyltriazole, di-(linear or branched) octylaminomethyltolyltriazole, di-(linear or branched) nonylaminomethyltolyltriazole, di-(linear or branched) decylaminomethyltolyltriazole, di-(linear or branched) undecylaminomethyltolyltriazole, di-(linear or branched) dodecylaminomethyltolyltriazole; dimethylaminoethyltolyltriazole, diethylaminoethyltolyltriazole, di-(linear or branched) propylaminoethyltolyltriazole, di-(linear or branched) butylaminoethyltolyltriazole, di-(linear or branched) pentylaminoethyltolyltriazole, di-(linear or branched) hexylaminoethyltolyltriazole, di-(linear or branched) heptylaminoethyltolyltriazole, di-(linear or branched) octylaminoethyltolyltriazole, di-(linear or branched) nonylaminoethyltolyltriazole, di-(linear or branched) decylaminoethyltolyltriazole, di-(linear or branched) undecylaminoethyltolyltriazole, di-(linear or branched) dodecylaminoethyltolyltriazole; and mixtures of these.

The benzotriazole and/or a derivative thereof may be contained in any amount desired in the refrigerating machine oil of the present invention, but the amount is preferably not less than 0.001% by mass, and more preferably not less than 0.005% by mass, with respect to the total amount of the composition. If the amount is less than 0.001% by mass, the benzotriazole and/or a derivative thereof may not have the intended effect of enhancing anti-wear property and friction property. Also, the benzotriazole and/or a derivative thereof is preferably contained in an amount of not greater than 1.0% by mass, and more preferably not greater than 0.5% by mass, with respect to the total amount of the composition. If the amount exceeds 1.0% by mass, there may be no corresponding additional effect of enhancing anti-wear property and friction property, so exceeding this amount is undesirable from a cost standpoint.

Epoxy Compound

To further improve the stability and lubricity of the refrigerating machine oil of the present invention, it is preferable to add at least one type of epoxy compound selected from the group consisting of the following.

(1) phenylglycidyl ether epoxy compound
(2) alkylglycidyl ether epoxy compound
(3) glycidyl ester epoxy compound
(4) allyloxirane compound
(5) alkyloxirane compound
(6) alicyclic epoxy compound
(7) epoxidized fatty acid monoester
(8) epoxidized vegetable oil Specific examples of (1) phenylglycidyl ether epoxy compounds include phenylglycidyl ether and alkylphenylglycidyl ether. Examples of the alkylphenylglycidyl ether referred to here include those having from one to three $C_1$ to $C_{13}$ alkyl groups, of which those having one $C_4$ to $C_{10}$ alkyl group is preferable, examples of which include n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octylphenylglycidyl ether, nonylphenylglycidyl ether, and decylphenylglycidyl ether.

Specific examples of (2) alkylglycidyl ether epoxy compounds include decylglycidyl ether, undecylglycidyl ether, dodecylglycidyl ether, tridecylglycidyl ether, tetradecylglycidyl ether, 2-ethylhexylglycidyl ether, neopentylglycoldiglycidyl ether, trimethylolpropane triglycidyl ether, pentaerythritol tetraglycidyl ether, 1,6-hexanediol diglycidyl ether, sorbitolpolyglycidyl ether, polyalkyleneglycol monoglycidyl ether, and polyalkyleneglycol diglycidyl ether.

The examples of (3) glycidyl ester epoxy compound include the compounds expressed by the following General Formula (5).

[Chemical Formula 5]

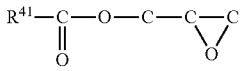

(5)

In Formula (5), $R^{41}$ is a $C_1$ to $C_{18}$ hydrocarbon group. Examples of such hydrocarbon groups include $C_1$ to $C_{18}$ alkyl groups, $C_2$ to $C_{18}$ alkenyl groups, $C_5$ to $C_7$ cycloalkyl groups, $C_6$ to $C_{18}$ alkylcycloalkyl groups, $C_6$ to $C_{10}$ aryl groups, $C_7$ to $C_{18}$ alkylaryl groups, and $C_7$ to $C_{18}$ arylalkyl groups. Of these, $C_5$ to $C_{15}$ alkyl groups, $C_2$ to $C_{15}$ alkenyl groups, and alkylphenyl groups having a phenyl group and a $C_1$ to $C_4$ alkyl group are preferable.

Specific examples of favorable glycidyl ester epoxy compounds include glycidyl-2,2-dimethyloctanoate, glycidyl benzoate, glycidyl-tert-butyl benzoate, glycidyl acrylate, and glycidyl methacrylate.

Specific examples of (4) allyloxirane compounds include 1,2-epoxystyrene and alkyl-1,2-epoxystyrene.

Specific examples of (5) alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxydecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

Specific examples of (6) alicyclic epoxy compounds include compounds in which carbon atoms constituting the epoxy groups directly constitute the alicyclic ring, such as compounds expressed by General Formula (6) below.

[Chemical Formula 6]

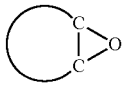

(6)

Specific examples of alicyclic epoxy compounds include 1,2-epoxycyclohexane, 1,2-epoxycyclopentane, 3,4-epoxycyclohexylmethyl-3,4-epoxycyclohexane carboxylate, bis(3,4-epoxycyclohexylmethyl) adipate, exo-2,3-epoxynorbornane, bis(3,4-epoxy-6-methylcyclohexylmethyl)adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane, and 4-epoxyethyl-1,2-epoxycyclohexane.

Specific examples of (7) epoxidized fatty acid monoesters include esters of epoxidized $C_{12}$ to $C_{20}$ fatty acids and $C_1$ to $C_8$ alcohols, phenols, or alkylphenols. It is particularly favorable to use a butyl, hexyl, benzyl, cyclohexyl, methoxyethyl, octyl, phenyl, or butylphenyl ester of epoxystearic acid.

Specific examples of (8) epoxidized vegetable oils include epoxy compounds of vegetable oils such as soybean oil, linseed oil, and cottonseed oil.

Among these epoxy compounds, phenylglycidyl ether epoxy compounds, glycidyl ester epoxy compounds, alicyclic epoxy compounds, and epoxidized fatty acid monoesters are preferred, and glycidyl ester epoxy compounds and alicyclic epoxy compounds are better yet.

When one of these epoxy compounds is added to the refrigerating machine oil of the present invention, there are no particular restrictions on the amount in which it is added, but usually it is preferable for the epoxy compound to be added in an amount of 0.1 to 5.0% by mass, and more preferably 0.2 to 2.0% by mass, with respect to the total amount of the refrigerating machine oil (the sum of the base oil and all of the added additives).

Obviously, two or more types of the above-mentioned phosphorus compounds and epoxy compounds can be used together.

Oiliness Agent

The refrigerating machine oil of the present invention can further contain an oiliness agent. Examples of oil-based agents include ester oiliness agents, monohydric alcohol oiliness agents, carboxylic acid oiliness agents, and ether oiliness agents.

An ester oiliness agent is obtained by reacting an alcohol with a carboxylic acid. The alcohol here may be either a monohydric alcohol or a polyhydric alcohol. The carboxylic acid may be a monobasic acid or a polybasic acid.

The monohydric alcohol that constitutes the ester oiliness agent is usually one with a carbon number of 1 to 24, and preferably 1 to 12, and more preferably 1 to 8, and this alcohol may be linear or branched, and may be saturated or unsaturated. Specific examples of $C_1$ to $C_{24}$ alcohols include methanol, ethanol, linear or branched propanol, linear or branched butanol, linear or branched pentanol, linear or branched hexanol, linear or branched heptanol, linear or branched octanol, linear or branched nonanol, linear or branched decanol, linear or branched undecanol, linear or branched dodecanol, linear or branched tridecanol, linear or branched tetradecanol, linear or branched pentadecanol, linear or branched hexadecanol, linear or branched heptadecanol, linear or branched octadecanol, linear or branched nonadecanol, linear or branched eicosanol, linear or branched heneicosanol, linear or branched tricosanol, linear or branched tetracosanol, and mixtures of these.

The polyhydric alcohol that constitutes the ester oiliness agent is usually from dihydric to decahydric, and preferably dihydric to hexahydric. Specific examples of dihydric to decahydric alcohols include ethylene glycol, diethylene glycol, polyethylene glycol (trimer to pentadecamer of ethylene glycol), propylene glycol, dipropylene glycol, polypropylene glycol (trimer to pentadecamer of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, neopentyl glycol, and other such dihydric alcohols; glycerol, polyglycerol (dimer to octamer of glycerol, such as diglycerol, triglycerol, and tetraglycerol), trimethylolalkanes (such as trimethylolethane, trimethylolpropane, and trimethylolbutane) and dimer to octamer thereof, pentaerythritol and dimer to tetramer thereof, 1,2,4-butanetriol, 1,3,5-pentanetriol, 1,2,6-hexanetriol, 1,2,3,4-butanetetrol, sorbitol, sorbitan, sorbitol-glycerol condensate, adonitol, arabitol, xylytol, mannitol, and other polyhydric alcohols; xylose, arabinose, ribose, rhamnose, glucose, fructose, galactose, mannose, sorbose, cellobiose, maltose, isomaltose, trehalose, sucrose, and other such saccharides; and mixtures of these.

Of these polyhydric alcohols, preferable are ethylene glycol, diethylene glycol, polyethylene glycol (trimer to decamer of ethylene glycol), propylene glycol, dipropylene glycol, polypropylene glycol (trimer to decamer of propylene glycol), 1,3-propanediol, 2-methyl-1,2-propanediol, 2-methyl-1,3-propanediol, neopentyl glycol, glycerol, diglycerol, triglycerol, trimethylolalkanes (such as trimethylolethane, trimethylolpropane, and trimethylolbutane) and dimer to tetramer thereof, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol-glycerol condensate, adonitol, arabitol, xylytol, mannitol, and other dihydric to hexahydric alcohols, and mixtures of these. Even more preferable are ethylene glycol, propylene glycol, neopentyl glycol, glycerol, trimethylolethane, trimethylolpropane, pentaerythritol, sorbitan, and mixtures of these. Of these, neopentyl glycol, trimethylolethane, trimethylolpropane, pentaerythritol, and mixtures of these are preferred.

As mentioned above, the alcohol that constitutes the ester oiliness agent may be a monohydric alcohol or a polyhydric alcohol, but in terms of further increasing anti-wear property and friction property, and in terms of preventing precipitation at low temperatures or under a refrigerant atmosphere, a monohydric alcohol is preferable.

Of the acids that can constitute the ester oiliness agent, a monobasic acid is usually a $C_2$ to $C_{24}$ fatty acid, which may be either linear or branched, and which may be either saturated or unsaturated. Specific examples include acetic acid, propionic acid, linear or branched butanoic acid, linear or branched pentanoic acid, linear or branched hexanoic acid, linear or branched heptanoic acid, linear or branched octanoic acid, linear or branched nonanoic acid, linear or branched decanoic acid, linear or branched undecanoic acid, linear or branched dodecanoic acid, linear or branched tridecanoic acid, linear or branched tetradecanoic acid, linear or branched pentadecanoic acid, linear or branched hexadecanoic acid, linear or branched heptadecanoic acid, linear or branched octadecanoic acid, linear or branched hydroxyoctadecanoic acid, linear or branched nonadecanoic acid, linear or branched eicosanoic acid, linear or branched heneicosanoic acid, linear or branched docosanoic acid, linear or branched tricosanoic acid, linear or branched tetracosanoic acid, and other such saturated fatty acids; acrylic acid, linear or branched butenoic acid, linear or branched pentenoic acid, linear or branched hexenoic acid, linear or branched heptenoic acid, linear or branched octenoic acid, linear or branched nonenoic acid, linear or branched decenoic acid, linear or branched undecenoic acid, linear or branched dodecenoic acid, linear or branched tridecenoic acid, linear or branched tetradecenoic acid, linear or branched pentadecenoic acid, linear or branched hexadecenoic acid, linear or branched heptadecenoic acid, linear or branched octadecenoic acid, linear or branched hydroxyoctadecenoic acid, linear or branched nonadecenoic acid, linear or branched eicosenoic acid, linear or branched heneicosenoic acid, linear or branched docosenoic acid, linear or branched tricosenoic acid, linear or branched tetracosenoic acid, and other such unsaturated fatty acids; and mixtures of these.

Examples of polybasic acids include a dibasic acid and trimellitic acid, but in terms of preventing precipitation at low temperatures or under a refrigerant atmosphere, a dibasic acid is preferable. This dibasic acid may be either a chain-form dibasic acid or a cyclic dibasic acid. In the case of a chain-form dibasic acid, it may be either linear or branched, and may be either saturated or unsaturated. The chain-form dibasic acid is preferably a $C_2$ to $C_{16}$ chain-form dibasic acid, specific examples of which include ethane diacid, propane diacid, linear or branched butane diacid, linear or branched pentane diacid, linear or branched hexane diacid, linear or branched heptane diacid, linear or branched octane diacid, linear or branched nonane diacid, linear or branched decane diacid, linear or branched undecane diacid, linear or branched dodecane diacid, linear or branched tridecane diacid, linear or branched tetradecane diacid, linear or branched heptadecane diacid, linear or branched hexadecane diacid, linear or branched hexene diacid, linear or branched heptene diacid, linear or branched octene diacid, linear or branched nonene diacid, linear or branched decene diacid, linear or branched undecene diacid, linear or branched dodecene diacid, linear or branched tridecene diacid, linear or branched tetradecene diacid, linear or branched heptadecene diacid, linear or branched hexadecene diacid, and mixtures of these. Examples of cyclic dibasic acids include 1,2-cyclohexanedicarboxylic acid, 4-cyclohexene-1,2-dicarboxylic acid, and aromatic dicarboxylic acid. Of these, chain-form dibasic acids are preferred.

As mentioned above, the acid that constitutes the ester oiliness agent may be either a monobasic acid or a polybasic acid, but in terms of enhancing anti-wear property and friction property, a monobasic acid is preferable.

There are no particular restrictions on how the alcohol and acid are combined in the ester oiliness agent, but examples include the following ester combinations (i) to (vii).

(i) an ester of a monohydric alcohol and a monobasic acid (ii) an ester of a polyhydric alcohol and a monobasic acid (iii) an ester of a monohydric alcohol and a polybasic acid (iv) an ester of a polyhydric alcohol and a polybasic acid (v) a mixed ester of a mixture of monohydric alcohol and polyhydric alcohol and a polybasic acid (vi) a mixed ester of a polyhydric alcohol and a mixture of polybasic acid and monobasic acid (vii) a mixed ester of a mixture of monohydric alcohol and polyhydric alcohol and a mixture of polybasic acid and monobasic acid Each of the ester oiliness agents in (ii) to (vii) above may be a complete ester in which all of the hydroxyl groups of the polyhydric alcohol or the carboxyl groups of the polybasic acid have been esterified, or may be a partial ester in which some of the hydroxyl groups or carboxyl groups remain, but a complete ester is preferable in terms of have less effect on the ability to prevent precipitation at low temperatures or under a refrigerant atmosphere, and a partial ester is preferable in terms of enhancing friction property.

Of the ester oiliness agents of (i) to (vii) above, an ester of a monohydric alcohol and a monobasic acid (i) or an ester of a monohydric alcohol and a polybasic acid (iii) is preferable, and the ester of (i) is best of all. These esters are extremely effective at enhancing anti-wear property and friction property, and have little effect on the ability to prevent precipitation at low temperatures or under a refrigerant atmosphere.

In terms of further enhancing the anti-wear property and friction characteristics when a phosphorothionate is also used, and in terms of thermal and oxidation stability, the carbon number of the monobasic acid in the ester of (i) above is preferably not less than 10, and more preferably not less than 12, and even more preferably not less than 14. In terms of preventing precipitation at low temperatures or under a refrigerant atmosphere, the carbon number of the monobasic acid is preferably not more than 28, and more preferably not more than 26, and even more preferably not more than 24. Examples of such esters include methyl stearate, butyl stearate, methyl palmitate, and isopropyl palmitate.

The dibasic acid in the ester of (iii) above is preferably in chain form. Examples of such esters include diisodecyl adipate, diisononyl adipate, and diisobutyl adipate.

Also, the refrigerating machine oil of the present invention may sometimes contain an ester as its base oil, in which case the ester serving as the base oil is at least one type selected from among polyol esters and diesters of an alicyclic dibasic acid, and the ester oiliness agent is preferably one or more types selected from among esters of a monohydric alcohol and a monobasic acid, and esters of a chain-form dibasic acid and a monohydric alcohol.

Examples of monohydric alcohol oiliness agents include the monohydric alcohols listed as examples in the description of the ester oiliness agent above. From the standpoint of enhancing friction property and anti-wear property, the total carbon number of the monohydric alcohol oiliness agent is preferably not less than 6, and more preferably not less than 8, and even more preferably not less than 10. If the total carbon number is too large, there is the danger that precipitation will tend to occur in a refrigerant atmosphere, so the total carbon number is preferably not greater than 20, and more preferably not greater than 18, with not greater than 16 being best.

The carboxylic acid oiliness agent may be either a monobasic acid or a polybasic acid. Examples of this carboxylic acid include the monobasic acids and polybasic acids listed in the description of the ester oiliness agent. Of these, a monobasic acid is preferable in terms of friction property and anti-wear property. From the standpoint of enhancing friction property and anti-wear property, the total carbon number of the carboxylic acid oiliness agent is preferably not less than 6, and more preferably not less than 8, and even more preferably not less than 10. If the total carbon number of the carboxylic acid oiliness agent is too large, there is the danger that precipitation will tend to occur in a refrigerant atmosphere, so the total carbon number is preferably not greater than 20, and more preferably not greater than 18, with not greater than 16 being best.

Examples of ether oiliness agents include etherified trivalent to hexavalent aliphatic polyhydric alcohols, and etherified bimolecular condensates and trimolecular condensates of trivalent to hexavalent aliphatic polyhydric alcohols.

Etherified trivalent to hexavalent aliphatic polyhydric alcohols are expressed by the following General Formulas (7) to (12), for example.

[Chemical Formula 7]

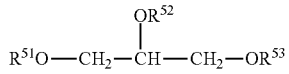

(7)

[Chemical Formula 8]

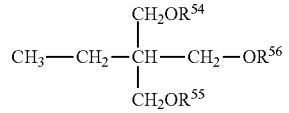

(8)

[Chemical Formula 9]

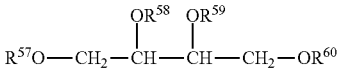

(9)

[Chemical Formula 10]

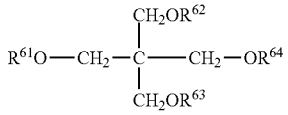

(10)

[Chemical Formula 11]

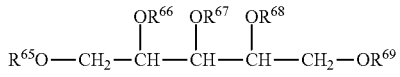

(11)

[Chemical Formula 12]

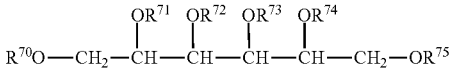

(12)

(In the formulas, $R^{51}$ to $R^{75}$ may be the same or different, and are each a hydrogen atom or a $C_1$ to $C_{18}$ linear or branched alkyl group, aryl group, aralkyl group, or a glycol ether residue expressed by $—(R^aO)_n—R^b$ (where $R^a$ is a $C_2$ to $C_6$ alkylene group, $R^b$ is a $C_1$ to $C_{20}$ alkyl group, aryl group, or aralkyl group, and n is an integer from 1 to 10).)

Specific examples of trivalent to hexavalent aliphatic polyhydric alcohols include glycerol, trimethylolpropane, erythritol, pentaerythritol, arabitol, sorbitol, and mannitol. Examples of $R^{51}$ to $R^{75}$ in the above General Formulas (7) to (12) include a methyl group, ethyl group, n-propyl group, isopropyl group, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, a phenyl group, and a benzyl group. The above-mentioned etherified compound encompasses partially etherified compounds in which some of the $R^{51}$ to $R^{75}$ groups are hydrogen atoms.

Examples of etherified bimolecular condensates and trimolecular condensates of trivalent to hexavalent aliphatic polyhydric alcohols include the same or different types of condensates of the compounds expressed by General Formulas (7) to (12). For instance, etherified bimolecular condensates and trimolecular condensates of the alcohols expressed by General Formula (7) are expressed by General Formulas (13) and (14), respectively. Etherified bimolecular condensates and trimolecular condensates of the alcohols expressed by General Formula (10) are expressed by General Formulas (15) and (16), respectively.

[Chemical Formula 13]

(13)

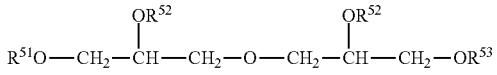

[Chemical Formula 14]

(14)

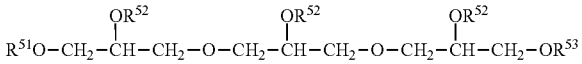

[Chemical Formula 15]

(15)

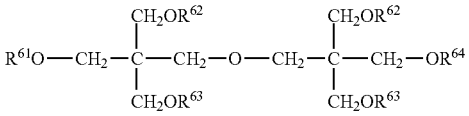

[Chemical Formula 16]

(16)

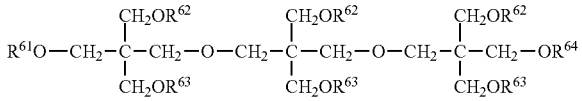

(In the formulas, $R^{51}$ to $R^{53}$ and $R^{61}$ to $R^{64}$ are defined the same as $R^{51}$ to $R^{53}$ in Formula (7) and $R^{61}$ to $R^{64}$ in Formula (10), respectively.)

Specific examples of bimolecular condensates and trimolecular condensates of trivalent to hexavalent aliphatic polyhydric alcohols include diglycerol, ditrimethylolpropane, dipentaerythritol, disorbitol, triglycerol, tritrimethylolpropane, tripentaerythritol, and trisorbitol.

Specific examples of the ether oiliness agents expressed by General Formulas (7) to (12) include a trihexyl ether of glycerol, dimethyloctyl triether of glycerol, di(methyloxyisopropylene)dodecyl triether of glycerol, diphenyloctyl triether of glycerol, di(phenyloxyisopropylene)dodecyl triether of glycerol, trihexyl ether of trimethylolpropane, dimethyloctyl triether of trimethylolpropane, di(methyloxyisopropylene) dodecyl triether of trimethylolpropane, tetrahexyl ether of pentaerythritol, trimethyloctyl tetraether of pentaerythritol, tri(methyloxyisopropylene)dodecyl tetraether of pentaerythritol, hexapropyl ether of sorbitol, tetramethyloctyl pentaether of sorbitol, hexa(methyloxyisopropylene) ether of sorbitol, tetrabutyl ether of diglycerol, dimethyldioctyl tetraether of diglycerol, tri(methyloxyisopropylene)dodecyl tetraether of diglycerol, pentaethyl ether of triglycerol, trimethyldioctyl pentaether of triglycerol, tetra(methyloxyisopropylene)decyl pentaether of triglycerol, tetrabutyl ether of ditrimethylolpropane, dimethyldioctyl tetraether of ditrimethylolpropane, tri(methyloxyisopropylene)dodecyl tetraether of ditrimethylolpropane, pentaethyl ether of tritrimethylolpropane, trimethyldioctyl pentaether of tritrimethylolpropane, tetra(methyloxyisopropylene)decyl pentaether of tritrimethylolpropane, hexapropyl ether of dipentaerythritol, pentamethyloctyl hexaether of dipentaerythritol, hexa(methyloxyisopropylene) ether of dipentaerythritol, octapropyl ether of tripentaerythritol, pentamethyloctyl hexaether of tripentaerythritol, hexa(methyloxyisopropylene) of tripentaerythritol, octamethyldioctyl decaether of disorbitol, and deca(methyloxyisopropylene) ether of disorbitol. Of these, a diphenyloctyl triether of glycerol, di(methyloxyisopropylene)dodecyl triether of trimethylolpropane, tetrahexyl ether of pentaerythritol, hexapropyl ether of sorbitol, dimethyldioctyl tetraether of diglycerol, tetra(methyloxyisopropylene) decyl pentaether of triglycerol, hexapropyl ether of dipentaerythritol, and pentamethyloctyl hexaether of tripentaerythritol are preferable.

Of the above-mentioned ester oiliness agents, monohydric alcohol oiliness agents, carboxylic acid oiliness agents, and ether oiliness agents, as long as it is used along with the phosphorothionate and the phosphorus-based additive other than a phosphorothionate in the refrigerating machine oil of the present invention, just one type of oiliness agent may be used alone, or a combination of two or more types may be used. Of these oiliness agents, ester oiliness agents and ether oiliness agents are preferred in terms of being able to achieve good friction characteristics and wear characteristics, with a good balance between these. Adding an ester oiliness agent and an ether oiliness agent has the effect of allowing even better anti-wear property and friction characteristics to be obtained. Ester oiliness agents and ether oiliness agents are also better at preventing precipitation than monohydric alcohol oiliness agents, and have better stability than carboxylic acid oiliness agents.

The above-mentioned oiliness agents can be contained in any amount desired, but from the standpoint of a good increase in anti-wear property and friction characteristics resulting from the use of a phosphorothionate along with a phosphorus-based additive other than a phosphorothionate, the amount is preferably not less than 0.01% by mass, and more preferably not less than 0.05% by mass, and even more preferably not less than 0.1% by mass, with respect to the total amount of the refrigerating machine oil. In terms of preventing precipitation at low temperatures and under a refrigerant atmosphere, and of obtaining better thermal and oxidation stability in the refrigerating machine oil, this content is preferably not more than 10% by mass, and more preferably not more than 7.5% by mass, and even more preferably not more than 5% by mass with respect to the total amount of the composition.

The ratio (mass ratio) of the combined amount in which the phosphorothionate and the phosphorus-based additive other than phosphorothionate are contained to the amount in which the oiliness agent is contained in preferably from 1:10 to 10:1, and more preferably 1:5 to 5:1, and even more preferably 1:3 to 1:1. By confining the ratio (mass ratio) of the combined amount in which the phosphorothionate and the phosphorus-based additive other than phosphorothionate, abrasive resistance and frictional properties can be improved.

Other Additives

In order to further improve performance, known refrigerating machine oil additives can be added as needed to the refrigerating machine oil of the present invention, examples of which include phenol-based antioxidants such as di-tert-butyl-p-cresol and bisphenol A; amine-based antioxidants such as phenyl-α-naphthylamide and N,N-di(2-naphthyl)-p-phenylenediamine; wear inhibitors such as zinc dithiophosphate; extreme pressure agents such as chlorinated paraffin and sulfur compounds; antifoaming agents such as those based on silicone; viscosity index improvers; pour-point depressants; detergent dispersants; and other such additives, either alone or in combinations of two or more types. There are no particular restrictions on the total amount in which these additives are added, but this amount is preferably not more than 10% by mass, and more preferably not more than 5% by mass, with respect to the total amount of the refrigerating machine oil (the combined amount of the base oil and all of the additives).

There are no particular restrictions on the volume resistivity of the refrigerating machine oil of the invention, but it is preferably not less than $1.0\times1^{13}$ Ω·cm. In particular, when the oil is used for a sealed type of refrigerating machine, high electrical insulation tends to be necessary. The term "volume resistivity" as used here means the value (Ω·cm) at 25° C. as measured according to JIS C 2101 "Electric Insulating Oil Testing Method."

There are no particular restrictions on the moisture content of the refrigerating machine oil of the invention, but it is preferably not more than 100 ppm, more preferably not more than 75 ppm, and most preferably not more than 50 ppm, with respect to the total amount of the refrigerating machine oil. In particular, when the oil is used for a sealed type of refrigerating machine, a low moisture content is required from the standpoint of its effects on the thermal and hydrolytic stability and the electric insulating property of the oil.

Nor are there any particular restrictions on the acid value of the refrigerating machine oil of the invention, but it is preferably not more than 0.1 mgKOH/g, and more preferably not more than 0.05 mgKOH/g, in order to prevent the corrosion of metal used in a refrigerating machine or piping. The term "acid value" as used here means the value (mgKOH/g) measured according to JIS K 2501 "Petroleum Products and Lubricating Oils—Neutralization Value Testing Method."

Nor are there any particular restrictions on the ash content of the refrigerating machine oil of the invention, but in order to improve the thermal and hydrolytic stability of the refrigerating machine oil of the present invention and thereby reduce the generation of sludge and the like, it is preferably not greater than 100 ppm, and more preferably not greater than 50 ppm. In the present invention, the term "ash content" means the value (ppm) measured according to JIS K 2272 "Testing Method for Ash Content and Sulfuric Acid Ash Content in Crude Oils and Petroleum Products."

The pour point of the refrigerating machine oil of the present invention is preferably not higher than 0° C., and more preferably not higher than −10° C., and even more preferably not higher than −20° C., with −30° C. or lower being best of all. If the pour point of the refrigerating machine oil is over 0° C., the oil may become a solid at normal temperature and will tend to be more difficult to handle.

The upper limit to the kinematic viscosity at 40° C. of the refrigerating machine oil of the present invention is preferably 200 $mm^2/s$, and more preferably 100 $mm^2/s$. The lower limit to the kinematic viscosity of the refrigerating machine oil is preferably 3 $mm^2/s$, and more preferably 5 $mm^2/s$. If the kinematic viscosity exceeds this upper limit, efficiency will tend to be poor in actual performance, but if the kinematic viscosity is under the lower limit, anti-wear property will tend to be poor.

Also, the viscosity coefficient of the refrigerating machine oil of the present invention is preferably not less than −10, and more preferably not less than 0. Fluidity at low temperature will tend to be poor if the viscosity coefficient is less than −10.

Examples of refrigerants that can be used in refrigerating and air conditioning machines that make use of the refrigerating machine oil of the present invention include CFC refrigerants, HCFC refrigerants, HFC refrigerants, perfluoroethers, and other such fluorine-containing ether-based refrigerants, dimethyl ether and other such non-fluorine-containing ether-based refrigerants, and ammonia, hydrocarbons, and other such natural refrigerants. These may be used singly or in mixtures of two or more types.

Examples of CFC refrigerants include $C_1$ to $C_3$, and preferably $C_1$ or $C_2$, chlorofluorocarbons. Specific examples include trichloromonofluoromethane (R12), dichlorodifluoromethane (R12), monochlorotrifluoromethane (R13), tetrafluoromethane (R14), tetrachlorodifluoroethane (R112), trichlorotrifluoroethane (R113), dichlorotetrafluoroethane (R114), and monochloropentafluoroethane (R115). Examples of HCFCs include monochlorodifluoroethane (R22) and monochlorodifluoroethane (R142b). Examples of HCFC refrigerants include $C_1$ to $C_3$, and preferably $C_1$ or $C_2$, hydrochlorofluorocarbons. Examples of HCFC refrigerants include $C_1$ to $C_3$, and preferably $C_1$ or $C_2$, hydrofluorocarbons. Specific examples include difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a), and other such HFCs, and mixtures of two or more of these. These refrigerants are suitably selected according to the intended use and the required performance, but favorable examples include HFC-32 alone; HFC-23 alone; HFC-134a alone; HFC-125 alone; a mixture of 60 to 80% by mass HFC-134a and 40 to 20% by mass HFC-32; a mixture of 40 to 70% by mass HFC-32 and 60 to 30% by mass HFC-125; a mixture of 40 to 60% by mass HFC-125 and 60 to 40% by mass HFC-143a; a mixture of 60% by mass HFC-134a, 30% by mass HFC-32, and 10% by mass HFC-125; a mixture of 40 to 70% by mass HFC-134a, 15 to 35% by mass HFC-32, and 5 to 40% by mass HFC-125; and a mixture of 35 to 55% by mass HFC-125, 1 to 15% by mass HFC-134a, and 40 to 60% by mass HFC-143a. More specific examples include a mixture of 70% by mass HFC-134a and 30% by mass HFC-32; a mixture of 60% by mass HFC-32 and 40% by mass HFC-125; a mixture of 50% by mass HFC-32 and 50% by mass HFC-125 (R410A); a mixture of 45% by mass HFC-32 and 55% by mass HFC-125 (R410B); a mixture of 50% by mass HFC-125 and 50% by mass HFC-143a (R507C); a mixture of 30% by mass HFC-32, 10% by mass HFC-125, and 60% by mass HFC-134a; a mixture of 23% by mass HFC-32, 25% by mass HFC-125, and 52% by mass HFC-134a (R407C); a mixture of 25% by mass HFC-32, 15% by mass HFC-125, and 60% HFC-134a (R407E); and a mixture of 44% by mass HFC-125, 4% by mass HFC-134a, and 52% by mass HFC-143a (R404A).

Examples of natural refrigerants include carbon dioxide, ammonia, and hydrocarbons. The hydrocarbon refrigerant referred to here is preferably one that is a gas at 25° C. at 1 atm. More specifically, this is $C_1$ to $C_5$, and preferably $C_1$ to $C_4$, alkanes, cycloalkanes, and alkenes, and mixtures of these. Specific examples of such hydrocarbon refrigerants include methane, ethylene, ethane, propylene, propane, cyclopropane, butane, isobutane, cyclobutane, methylcyclopropane, and mixtures of two or more of these compounds. Of these, propane, butane, isobutane, and mixtures of these are preferred.

In a refrigerating machine, the refrigerating machine oil of the present invention is normally in the form of a refrigerating fluid composition mixed with one of the refrigerants described above. There are no particular restrictions on the mix ratio of the refrigerating oil and the refrigerant, but the amount of the refrigerating oil is from 1 to 500 weight parts, and more preferably 2 to 400 weight parts, per 100 weight parts of refrigerant.

The refrigerating machine oil of the invention strikes a good balance between all its performance requirements, such as lubricity, refrigerant miscibility, low temperature fluidity, and stability, and can be used favorably heat pumps, refrigerating machines, and so forth having a reciprocating or rotary, and open, semi-closed, or closed compressor. In particular, when the refrigerating machine oil of the invention is used in a refrigerating machine in which aluminum components are used, a high level of performance can be achieved in terms of both thermal/chemical stability and preventing the wear of the aluminum components. Specific examples of such refrigerating machines include automotive air conditioners, dehumidifiers, refrigerators, cold storage freezers, vending machines, showcases, cooling apparatus used in chemical plants and elsewhere, household air conditioners, large building air conditioner systems, and heat pumps used for supplying hot water. In particular, if the refrigerating machine oil of the present invention contains a mixture of the ester A-1 and ester A-2, the best performance will be extracted when it is used as a refrigerating oil for a package air conditioner. Furthermore, the refrigerating machine oil of the present invention can be used in all types of compressors, such as reciprocating, rotary, centrifugal, and other such types.

A refrigerant circulation system in which the refrigerating machine oil of the present invention can be used favorably is typically made up of a refrigerant compressor, a condenser, an expander, and an evaporator, which are connected in that order along the flow path, and if necessary a drier may also be provided along the flow path.

Examples of refrigerant compressors include a high-pressure vessel type of compressor in which a motor comprising a rotor and a stator, a rotating shaft fitted in the rotor, and a compressor component linked to the motor via this rotating shaft are housed in a closed vessel filled with a refrigerating oil, and high-pressure refrigerant gas discharged from the compressor component is collected in the closed vessel; and a low-pressure vessel type of compressor in which a motor comprising a rotor and a stator, a rotating shaft fitted in the rotor, and a compressor component linked to the motor via this rotating shaft are housed in a closed vessel filled with a refrigerating oil, and high-pressure refrigerant gas discharged from the compressor component is directly discharged out of the closed container.

An insulating film used as the electric insulating system material for the motor may be a crystalline plastic film with a glass transition point of 50° C. or higher, specific examples of which include one or more types of insulating film selected from the group consisting of polyethylene terephthalate, polybutylene terephthalate, polyphenylene sulfide, polyether ether ketone, polyethylene naphthalate, polyamideimide, and polyimide, as well as composite films in which a resin layer with a high glass transition point covers a film with a low glass transition point. These are preferred because of their resistance to deterioration in tensile strength and electric insulating property. The magnet wire which is used for the motor is preferably one with an enamel coating having a glass transition point of 120° C. or higher, such as a single layer of polyester, polyester imide, polyamide, or polyamideimide, or an enamel coating which is a composite coating of an upper layer with a high glass transition point over a lower layer with a low glass transition point. Examples of composite coating enamel wires include those in which a polyamideimide upper layer covers a polyester imide lower layer (AI/EI), and those in which a polyamideimide upper layer covers a polyester lower layer (AI/PE).

The drying agent packed in the drier is preferably a synthetic zeolite composed of an alkali metal silicate/aluminate compound salt with a carbon dioxide gas absorption volume of not greater than 1.0% at a pore size of 3.3 Angstroms or smaller and a carbon dioxide gas partial pressure of 250 mmHg at 25° C. Specific examples include XH-9, XH-10, XH-11, and XH-600, which are trade names of Union Showa Co., Ltd.

EXAMPLES

The present invention will now be described in more specific terms by way of examples and comparative examples, but the invention is in no way limited to or by these examples.

Examples 1 and 2 and Comparative Examples 1 to 3

Refrigerating machine oils composed of the base oils listed below were used in Examples 1 and 2 and Comparative Examples 1 to 3.

Base Oils

Base oil 1: mineral oil with a sulfur content of 48 ppm by mass, a nitrogen content of 15 ppm by mass, a percent in aromatic ring structures (% $C_A$) of 11, and a kinematic viscosity at 40° C. of 56.1 $mm^2/s$ Base oil 2: mineral oil with a sulfur content of 15 ppm by mass, a nitrogen content of 10 ppm by mass, a percent in aromatic ring structures (% $C_A$) of 12, and a kinematic viscosity at 40° C. of 55.5 $mm^2/s$ Base oil 3: mineral oil with a sulfur content of 200 ppm by mass, a nitrogen content of 8 ppm by mass, a percent in aromatic ring structures (% $C_A$) of 8, and a kinematic viscosity at 40° C. of 52.8 $mm^2/s$ Base oil 4: mineral oil with a sulfur content of 25 ppm by mass, a nitrogen content of 62 ppm by mass, a percent in aromatic ring structures (% $C_A$) of 8, and a kinematic viscosity at 40° C. of 55.3 $mm^2/s$ Base oil 5: mineral oil with a sulfur content of 20 ppm by mass, a nitrogen content of 8 ppm by mass, a percent in aromatic ring structures (% $C_A$) of 30, and a kinematic viscosity at 40° C. of 56.5 $mm^2/s$ Next, the following tests were carried out to evaluate the refrigerating machine oils of Examples 1 and 2 and Comparative Examples 1 to 3.

Stability Evaluation

A sealed glass tube test was carried out as set forth in JIS K 2211, using iron, copper, and aluminum as catalysts, and the sample was held under conditions of temperatures at 175° C. or 200° C. for 2 weeks and then checked to see if there was any sludge and if the catalyst had changed. The refrigerant used here was R22. The results thus obtained are given in Table 1. In the column labeled "Sludge" in Table 1, A means that no sludge was noted, and B that sludge was noted. In the column labeled "Catalyst change" in Table 1, A means that there was no change, B that the catalyst changed slightly, and C that the catalyst changed markedly.

The change in color of the oil was evaluated according to ASTM D1500. The rating of the color of the oil change was such that up to L2.0 was considered pass, and L2.5 or over was considered fail.

Evaluation of Anti-Wear Property

The sliding component of a Falex tester (ASTM D2714) was placed in a pressure-resistant vessel, an R22 refrigerant was introduced into the vessel, and a Falex test was carried out under the following conditions.

Test starting temperature: 80° C.

Test duration: 30 minutes

Amount of refrigerant blown in: 10 L/hour

The block was weighed before and after the Falex test, and the amount of wear was found as the reduction in weight. The results thus obtained are given in Table 1.

Miscibility

Miscibility was evaluated according to JIS K 2211, attachment 3. 10 g of sample and 40 g of R22 refrigerant were weighed out in a 100 mL pressure-resistant test tube. The sample was then heated in a 30° C. water bath and the sample oil was uniformly mixed with the refrigerant. The test tube was then cooled at a rate of 1° C./min, and the temperature was measured at which either the solution separated into two layers or the entire solution became emulsified. This temperature was used to evaluate miscibility. The results thus obtained are given in Table 1.

TABLE 1

| | | | Example | | | Comparative Example | |
|---|---|---|---|---|---|---|---|
| | | | 1 | 2 | 3 | 1 | 2 |
| Composition | Base oil | | base oil 1 | base oil 2 | base oil 3 | base oil 4 | base oil 5 |
| Evaluation | Stability (175° C.) | Sludge | A | A | A | C | A |
| | | Catalyst change | A | A | B | A | A |
| | | ASTM color | L0.5 | L0.5 | L0.5 | L0.5 | L2.5 |
| | Stability (200° C.) | Sludge | A | B | A | C | A |
| | | Catalyst change | B | A | C | A | A |
| | | ASTM color | L1.5 | L0.5 | L0.5 | L0.5 | L3.0 |
| | Anti-wear property (mg) | | 8.2 | 10.8 | 10.9 | 10.7 | 7.8 |
| | Miscibility (° C.) | | 3 | 6 | 7 | 8 | 4 |

Examples 4 to 16

Refrigerating machine oils have the compositions shown in Tables 2 and 3 were prepared using the base oils and additives listed below, for Examples 4 to 16. The additive contents given in Tables 2 and 3 are the amounts with respect to the total amount of refrigerating machine oil.

Base Oils

Base oil 6: mineral oil with a sulfur content of 43 ppm by mass, a nitrogen content of 5 ppm by mass, a percent in aromatic ring structures (% $C_A$) of 10, and a kinematic viscosity at 40° C. of 57.2 $mm^2/s$ Phosphorus-Based Additives A1: tricresyl phosphate A2: triphenyl phosphorothionate Epoxy-Based Additive B1: glycidyl-2,2'-dimethyl octanoate Oiliness Agents C1: butylstearate C2: octylglyceryl ether C3: diisodecyl adipate C4: myristyl alcohol C5: lauric acid Next, the following tests were carried out to evaluate the refrigerating machine oils of Examples 4 to 16.

Stability Evaluation

A sealed glass tube test was carried out as set forth in JIS K 2211, using iron, copper, and aluminum as catalysts, and the sample was held at 200° C. for 2 weeks and then checked to see if there was any sludge and if the catalyst appearance had changed. The refrigerant used here was R22. The results thus obtained are given in Tables 2 and 3. In the column labeled "Sludge" in the tables, A means that no sludge was noted, and B that sludge was noted. In the column labeled "Catalyst change," A means that there was no change, B that the catalyst changed slightly, and C that the catalyst changed markedly in appearance.

Evaluation of Seizure Resistance

The sliding component of a Falex tester (ASTM D2714) was placed in a pressure-resistant vessel, an R22 refrigerant was introduced into the vessel, and a Falex test was carried out under the following conditions.

Test starting temperature: 80° C.

Test duration: 30 minutes

Amount of refrigerant blown in: 10 L/hour

The machine was operated for 5 minutes under an initial load of 100N, from the five-minute point the load was ratcheted up, and the load at the point of seizure was evaluated as the seizure load. The results thus obtained are given in Tables 2 and 3.

Evaluation of Anti-Wear Property

An R22 refrigerant was blown into the refrigerating machine oil while a Falex test was carried out under the following conditions (ASTM D2670).

Test starting temperature: 25° C.

Test duration: 30 minutes

Load: 1334N

Amount of refrigerant blown in: 10 L/hour

The coefficient of friction was measured once every second from the start of the Falex test, and the average of these measurements was found (average coefficient of friction). The results thus obtained are given in Tables 2 and 3.

TABLE 2

| | | | Example | | | | | | |
|---|---|---|---|---|---|---|---|---|---|
| | | | 4 | 5 | 6 | 7 | 8 | 9 | 10 |
| Composition | Base oil | | base oil 6 | base oil 6 | base oil 6 | base oil 6 | base oil 6 | base oil 6 | base oil 6 |
| | Additive content (% by mass) | A1 | 0.5 | 0.8 | 1.5 | 0.5 | 0.5 | 0.5 | 0.5 |
| | | A2 | 0.5 | 0.1 | 1.5 | 0.5 | 0.5 | 0.5 | 0.5 |
| | | B1 | — | — | — | 0.5 | — | — | — |
| | | C1 | — | — | — | — | 0.5 | — | — |
| | | C2 | — | — | — | — | — | 0.5 | — |
| | | C3 | — | — | — | — | — | — | 0.5 |
| | | C4 | — | — | — | — | — | — | — |
| | | C5 | — | — | — | — | — | — | — |
| Evaluation | Sludge | | A | A | A | A | A | A | A |
| | Catalyst change | | A | A | A | A | A | A | B |
| | Seizure load (N) | | 2442 | 2753 | 2797 | 2708 | 2753 | 2752 | 2708 |
| | Average coefficient of friction | | 0.125 | 0.128 | 0.130 | 0.120 | 0.110 | 0.115 | 0.116 |

TABLE 3

| | | | Example | | | | | |
|---|---|---|---|---|---|---|---|---|
| | | | 11 | 12 | 13 | 14 | 15 | 16 |
| Composition | Base oil | | 100 | 100 | 100 | 100 | 100 | 100 |
| | Additive content (% by mass) | A1 | 0.5 | 0.5 | 0.5 | 0.5 | 1.0 | — |
| | | A2 | 0.5 | 0.5 | 0.5 | 0.5 | — | 1.0 |
| | | B1 | — | — | 0.5 | 0.5 | — | — |
| | | C1 | — | — | 5 | — | — | — |
| | | C2 | — | — | — | 0.5 | — | — |
| | | C3 | — | — | — | — | — | — |
| | | C4 | 0.5 | — | — | — | — | — |
| | | C5 | — | 0.5 | — | — | — | — |
| Evaluation | Sludge | | A | A | A | A | A | B |
| | Catalyst change | | B | A | A | A | A | B |
| | Seizure load (N) | | 2731 | 2708 | 2775 | 2753 | 2131 | 2131 |
| | Average coefficient of friction | | 0.115 | 0.116 | 0.108 | 0.109 | 0.135 | 0.131 |

The invention claimed is:

1. A refrigerating machine oil, comprising:

a mineral oil obtained by hydrorefining and/or hydrotreatment of not less than 93.5% by mass;

at least one phosphorothionate selected from the group consisting of triphenyl phosphorothionate, tricresyl phosphorothionate, trixylenyl phosphorothionate, cresyl diphenyl phosphorothionate, and xylenyl diphenyl phosphorothionate, of 0.1 to 1.5% by mass; and at least one phosphoric acid ester selected from the group consisting of triphenyl phosphate, tricresyl phosphate, trixylenyl phosphate, cresyl diphenyl phosphate, and xylenyl diphenyl phosphate, of 0.5 to 1.5% by mass, based on the total amount of the refrigerating machine oil, wherein a nitrogen content in the mineral oil is no more than 20 ppm by mass, a percentage of aromatic ring structure (% $C_A$) in the mineral oil is from 10 to 15, a sulfur content in the mineral oil is no more than 48 ppm by mass, and a kinematic viscosity of the mineral oil at 40° C. is 55.5-57.2 $mm^2/s$.

* * * * *